US005708260A

United States Patent [19]

Maier et al.

[11] Patent Number: 5,708,260

[45] Date of Patent: Jan. 13, 1998

[54] SLIDE-RULE CALCULATOR FOR COMPUTING A SALARY REPLACEMENT VALUE

[75] Inventors: Steven F. Maier, Chapel Hill; Forrest B. Johnson; Barbara J. Lewis, both of Durham, all of N.C.

[73] Assignee: LearningBridge, Inc., Research Triangle Park, N.C.

[21] Appl. No.: 736,951

[22] Filed: Oct. 25, 1996

Related U.S. Application Data

[60] Provisional application No. 60/025,104, Aug. 30, 1996.

[51] Int. Cl.[6] ..... G06G 1/02

[52] U.S. Cl. ..... 235/70 R; 235/70 A; 235/89 R

[58] Field of Search ..... 235/70 R, 70 A, 235/70 B, 89 R, 85 R, 379

[56] References Cited

U.S. PATENT DOCUMENTS

| | | | |
|---|---|---|---|
| 1,336,900 | 4/1920 | Galloway . | |
| 1,492,313 | 4/1924 | Schilling . | |
| 1,540,895 | 6/1925 | Moir . | |
| 1,819,921 | 8/1931 | Rice . | |
| 2,130,967 | 9/1938 | Ross | 35/24 |
| 2,477,785 | 8/1949 | Brown | 235/89 |
| 2,531,633 | 11/1950 | Laurin | 235/89 |
| 2,572,531 | 10/1951 | Steinkoenig | 235/70 |
| 2,659,532 | 11/1953 | Brickner | 235/89 |
| 2,673,035 | 3/1954 | McTeer | 235/89 |
| 2,812,907 | 11/1957 | Kantrowitz | 235/89 |
| 3,034,708 | 5/1962 | Bean, Jr. | 235/61 |
| 3,289,931 | 12/1966 | Bennett et al. | 235/89 |
| 3,507,448 | 4/1970 | Vincent | 235/85 |
| 3,711,014 | 1/1973 | Tucker | 235/70 R |
| 3,933,305 | 1/1976 | Murphy | 235/70 A |
| 4,425,499 | 1/1984 | Newton | 235/70 R |
| 4,648,037 | 3/1987 | Valentino | 364/408 |
| 4,742,457 | 5/1988 | Leon et al. | 364/408 |
| 4,749,846 | 6/1988 | Deaver | 235/70 B |
| 4,994,657 | 2/1991 | Charwat | 235/70 R |
| 5,449,890 | 9/1995 | van Neck | 235/70 R |

*Primary Examiner*—Adolf Berhane

*Attorney, Agent, or Firm*—David A. Harlow; Moore & Van Allen, PLLC

[57] ABSTRACT

A retirement calculator for calculating a salary replacement value independent of current salary and a method of computing a total salary replacement value are disclosed. The retirement calculator is made up of a sleeve having an open end and a plurality of windows, and the calculator has an insert with a plurality of age values and a plurality of preliminary salary replacement values printed upon it. When the insert is inserted or positioned in the open end of the sleeve, one of the age values is visible through one of the windows on the sleeve. The preliminary salary replacement value corresponding to the visible age value is then visible in another window. The method of computing a total salary replacement value includes the steps of estimating a salary replacement value for social security benefits, estimating the ratio of current retirement savings to current annual pre-tax salary, adjusting the insert of the retirement calculator until one of the age values is present in the one of the windows on the sleeve, obtaining a preliminary salary replacement value for current savings corresponding to the age value and a given interest rate from another window on the sleeve, multiplying the preliminary salary replacement value for current savings by the ratio of current retirement savings to current annual salary to obtain an actual salary replacement value for current savings, estimating the percentage of current annual salary to be contributed to retirement savings in the future, obtaining a preliminary salary replacement value for future contributions corresponding to the age value and a given interest rate from yet another window on the sleeve, multiplying the preliminary salary replacement value for future contributions by the percentage of current annual pre-tax salary to be contributed to retirement savings in the future to obtain an actual salary replacement value for future contributions, adding the salary replacement value for social security benefits to the actual salary replacement value for current savings and to the actual salary replacement value for future contributions to obtain the total salary replacement value.

31 Claims, 11 Drawing Sheets

| 36 | 37 | 38 | 39 | 40 | 41 | 42 | 43 | 44 | 45 | 46 | 47 | 48 | 49 | 50 |
|---|---|---|---|---|---|---|---|---|---|---|---|---|---|---|
| 3.99 | 3.99 | 3.99 | 3.99 | 3.99 | 3.99 | 3.99 | 3.99 | 3.99 | 3.99 | 3.99 | 3.99 | 3.99 | 3.99 | 3.99 |
| 6.03 | 5.97 | 5.91 | 5.85 | 5.79 | 5.73 | 5.68 | 5.62 | 5.57 | 5.51 | 5.45 | 5.40 | 5.35 | 5.29 | 5.24 |
| 9.05 | 8.87 | 8.70 | 8.52 | 8.35 | 8.19 | 8.03 | 7.87 | 7.71 | 7.56 | 7.41 | 7.26 | 7.12 | 6.98 | 6.84 |
| 13.53 | 13.13 | 12.74 | 12.36 | 12.00 | 11.64 | 11.30 | 10.97 | 10.64 | 10.33 | 10.02 | 9.73 | 9.44 | 9.16 | 8.89 |
| 18.06 | 17.35 | 16.67 | 16.02 | 15.39 | 14.79 | 14.21 | 13.66 | 13.12 | 12.61 | 12.11 | 11.64 | 11.18 | 10.75 | 10.33 |
| 26.81 | 25.51 | 24.27 | 23.09 | 21.96 | 20.89 | 19.88 | 18.91 | 17.99 | 17.11 | 16.28 | 15.49 | 14.73 | 14.02 | 13.33 |
| 39.60 | 37.30 | 35.13 | 33.09 | 31.17 | 29.36 | 27.65 | 26.05 | 24.53 | 23.11 | 21.77 | 20.50 | 19.31 | 18.19 | 17.13 |
| 58.17 | 54.25 | 50.59 | 47.18 | 44.00 | 41.03 | 38.27 | 35.69 | 33.28 | 31.04 | 28.94 | 26.99 | 25.17 | 23.48 | 21.89 |
| 1.16 | 1.12 | 1.08 | 1.04 | 1.00 | 0.96 | 0.92 | 0.88 | 0.84 | 0.80 | 0.76 | 0.72 | 0.68 | 0.64 | 0.60 |
| 1.52 | 1.46 | 1.40 | 1.34 | 1.28 | 1.22 | 1.17 | 1.11 | 1.05 | 1.00 | 0.94 | 0.89 | 0.84 | 0.78 | 0.73 |
| 1.99 | 1.90 | 1.82 | 1.73 | 1.65 | 1.56 | 1.48 | 1.40 | 1.32 | 1.25 | 1.17 | 1.10 | 1.03 | 0.96 | 0.89 |
| 2.62 | 2.49 | 2.36 | 2.24 | 2.11 | 2.00 | 1.88 | 1.77 | 1.66 | 1.56 | 1.45 | 1.36 | 1.26 | 1.17 | 1.08 |
| 3.11 | 2.93 | 2.76 | 2.60 | 2.44 | 2.29 | 2.14 | 2.00 | 1.87 | 1.74 | 1.62 | 1.50 | 1.38 | 1.27 | 1.17 |
| 4.12 | 3.86 | 3.61 | 3.37 | 3.14 | 2.93 | 2.72 | 2.53 | 2.35 | 2.17 | 2.00 | 1.84 | 1.69 | 1.55 | 1.41 |
| 5.46 | 5.08 | 4.72 | 4.37 | 4.05 | 3.75 | 3.46 | 3.19 | 2.94 | 2.70 | 2.48 | 2.26 | 2.07 | 1.88 | 1.70 |
| 7.25 | 6.69 | 6.17 | 5.68 | 5.22 | 4.79 | 4.39 | 4.02 | 3.68 | 3.36 | 3.05 | 2.77 | 2.51 | 2.27 | 2.04 |

| 51 | 52 | 53 | 54 | 55 | 56 | 57 | 58 | 59 | 60 | 61 | 62 | 63 | 64 | 65 |
|---|---|---|---|---|---|---|---|---|---|---|---|---|---|---|
| 3.99 | 3.99 | 3.99 | 3.99 | 3.99 | 3.99 | 3.99 | 3.99 | 3.99 | 3.99 | 3.99 | 3.99 | 3.99 | 3.99 | 3.99 |
| 5.19 | 5.14 | 5.09 | 5.04 | 4.99 | 4.94 | 4.89 | 4.84 | 4.79 | 4.74 | 4.70 | 4.65 | 4.60 | 4.56 | 4.51 |
| 6.71 | 6.57 | 6.44 | 6.32 | 6.19 | 6.07 | 5.95 | 5.83 | 5.72 | 5.60 | 5.49 | 5.38 | 5.28 | 5.17 | 5.07 |
| 8.63 | 8.37 | 8.13 | 7.89 | 7.65 | 7.43 | 7.21 | 7.00 | 6.79 | 6.59 | 6.39 | 6.21 | 6.02 | 5.85 | 5.67 |
| 9.92 | 9.53 | 9.16 | 8.80 | 8.46 | 8.13 | 7.81 | 7.50 | 7.21 | 6.93 | 6.66 | 6.39 | 6.14 | 5.90 | 5.67 |
| 12.69 | 12.07 | 11.48 | 10.92 | 10.39 | 9.88 | 9.40 | 8.95 | 8.51 | 8.10 | 7.70 | 7.33 | 6.97 | 6.63 | 6.31 |
| 16.14 | 15.20 | 14.32 | 13.48 | 12.70 | 11.96 | 11.27 | 10.61 | 10.00 | 9.42 | 8.87 | 8.35 | 7.87 | 7.41 | 6.98 |
| 20.42 | 19.04 | 17.76 | 16.56 | 15.44 | 14.40 | 13.43 | 12.53 | 11.68 | 10.89 | 10.16 | 9.47 | 8.84 | 8.24 | 7.68 |
| 0.56 | 0.52 | 0.48 | 0.44 | 0.40 | 0.36 | 0.32 | 0.28 | 0.24 | 0.20 | 0.16 | 0.12 | 0.08 | 0.04 | 0.00 |
| 0.68 | 0.63 | 0.58 | 0.52 | 0.47 | 0.43 | 0.38 | 0.33 | 0.28 | 0.23 | 0.18 | 0.14 | 0.09 | 0.05 | 0.00 |
| 0.82 | 0.75 | 0.69 | 0.62 | 0.56 | 0.50 | 0.44 | 0.38 | 0.32 | 0.27 | 0.21 | 0.16 | 0.10 | 0.05 | 0.00 |
| 0.99 | 0.90 | 0.82 | 0.74 | 0.66 | 0.59 | 0.51 | 0.44 | 0.37 | 0.31 | 0.24 | 0.18 | 0.12 | 0.06 | 0.00 |
| 1.07 | 0.97 | 0.87 | 0.78 | 0.70 | 0.62 | 0.54 | 0.46 | 0.39 | 0.31 | 0.25 | 0.18 | 0.12 | 0.06 | 0.00 |
| 1.28 | 1.16 | 1.04 | 0.93 | 0.82 | 0.72 | 0.62 | 0.53 | 0.44 | 0.36 | 0.28 | 0.20 | 0.13 | 0.06 | 0.00 |
| 1.53 | 1.38 | 1.23 | 1.09 | 0.96 | 0.83 | 0.72 | 0.61 | 0.51 | 0.41 | 0.32 | 0.23 | 0.15 | 0.07 | 0.00 |
| 1.83 | 1.63 | 1.45 | 1.28 | 1.11 | 0.97 | 0.83 | 0.70 | 0.57 | 0.46 | 0.36 | 0.26 | 0.17 | 0.08 | 0.00 |

601

602

SALARY REPLACEMENT (SR) VALUES FOR SOCIAL SECURITY BENEFITS

The Social Security table below provides an estimate of your Social Security benefits, expressed as a Salary Replacement value. Choose the appropriate value based on your current age and salary. Your actual Social Security benefits depend on other factors, so this is only a rough estimate.

SOCIAL SECURITY BENEFITS - Salary Replacement (SR) Values

| Age \ Salary | $10,000 | $20,000 | $30,000 | $40,000 | $50,000 | Maximum Benefit* |
|---|---|---|---|---|---|---|
| 25 | 62% | 47% | 42% | 35% | 31% | $1,448 |
| 35 | 62% | 47% | 42% | 35% | 31% | $1,445 |
| 45 | 62% | 46% | 42% | 35% | 31% | $1,418 |
| 55 | 62% | 46% | 41% | 35% | 30% | $1,325 |
| 65 | 62% | 45% | 41% | 33% | 28% | $1,199 |

* If your salary exceeds $50,000, divide the maximum benefit by your monthly salary and multiply by 100 to compute your SR value.

603

PORTFOLIO ALLOCATION

Based on historical performance, the following table shows the mix of assets you will need to achieve various returns ranging from 4% to 11%. We suggest that you start with a return of 8%, then adjust that by how comfortable you are in assuming risk. You will need to select a return to complete the worksheet.

604

| | Stocks | Bonds | Cash |
|---|---|---|---|
| A (4%) | 0% | 0% | 100% |
| B (5%) | 11% | 14% | 75% |
| C (6%) | 23% | 26% | 51% |
| D (7%) | 37% | 32% | 31% |
| E (8%) | 47% | 39% | 14% |
| F (9%) | 65% | 35% | 0% |
| G (10%) | 85% | 15% | 0% |
| H (11%) | 100% | 0% | 0% |

*FIG. 6*

601

602

STEP BY STEP USE OF THE RETIREMENT CALCULATOR

The retirement calculator is used to compute a Salary Replacement (SR) value. It estimates the percentage of salary you will be able to replace with Social Security and savings when you retire. We suggest that you target a total SR value of 80. This means that at retirement, you will have 80% of your salary replaced by Social Security and savings.

| | | |
|---|---|---|
| **Step A: The SR Value of Social Security**<br>(1) Based on your age and income, use the Social Security table on the reverse side to estimate the SR value of your Social Security benefits. If you have a non-working spouse, multiply the SR value you find in the table by 1.5. | % (1) | 701 |
| **Step B: The SR Value of Your Current Savings**<br>(2) Estimate the ratio of your current retirement savings divided by your current annual pre-tax salary. Example: Your current savings total $15,000 and your annual salary is $30,000. Your ratio is 0.5. | (2) | 702 |
| (3) Use the retirement calculator to compute the SR value of your savings. | (3) | 703 |
| (4) Multiply line 2 times line 3 and enter on line 4. This is the SR value of your current savings. | % (4) | 704 |
| **Step C: The SR Value of Your Future Contributions**<br>(5) Write down the percentage of your salary you are considering putting into your 401(k). | (5) | 705 |
| (6) Use the retirement calculator to compute the SR value of your future contributions. | (6) | 706 |
| (7) Multiply line 5 times line 6 and enter on line 7. This is the SR value of your future contributions. | % (7) | 707 |
| **Step D: Your Total Picture**<br>(8) Add line 1, line 4, and line 7 together. This is your total SR value. Remember that you are trying to achieve an SR value of 80. If your number is low, adjust your contribution level or asset mix. | % (8) | 708 |

709

*FIG. 7*

SLIDE-RULE CALCULATOR FOR COMPUTING A SALARY REPLACEMENT VALUE

This application claims benefit of U.S. Provisional Application No. 60/025,104, filed Aug. 30, 1996.

FIELD OF THE INVENTION

The present invention relates to the field of slide-rule calculators and more particularly to the field of slide-rule calculators for use in retirement planning.

BACKGROUND OF THE INVENTION

For many decades, business people have used types of "slide rule" hand-held calculators to solve a variety of business and other personal calculations. Examples of such calculators are shown in U.S. Pat. No. 1,336,900, granted to Galloway on Apr. 13, 1920, and U.S. Pat. No. 5,449,890, granted to van Neck on Sep. 12, 1995. Typically, they have a light cardboard or plastic sleeve exterior which has printing and windows on the outside. There is, also, a moveable interior light cardboard or plastic insert with numbers placed on it, in either tabular or linear form. The inner cardboard insert is moved until certain of the numbers are visible from the outside through the windows in the exterior cardboard sleeve. The chart or designations on the outside cardboard sleeve and the numbers on the inside cardboard insert are arranged so that one can obtain answers from the numbers appearing in the windows according to the calculations which are outlined on the exterior cardboard sleeve.

Various calculators of this type have been used for years in the financial planning industry by planners, salesmen, and purchasers of insurance policies, annuities, retirement plans, and related products. Examples of such calculators are shown in U.S. Pat. No. 2,130,967, granted to Ross on Sep. 20, 1938, U.S. Pat. No. 2,673,035, granted to McTeer on Mar. 23, 1954, and U.S. Pat. No. 3,289,931, granted to Bennett on Dec. 6, 1966. For the calculators used in the planning and sale of retirement plan products, the basic idea is that the calculator will receive input as to certain variables and then make calculations based on the numbers listed on the inside cardboard insert, so that the user may calculate the amount of retirement income or principal which is available to the purchaser of the plan after he has made the necessary investments over a number of years. The variables in these calculations in one way or another typically include the present value of any savings or retirement fund, monthly or yearly contributions to the plan, years to retirement and age at retirement, rate of return, and the income of the target individual if future contributions are going to be considered as a percentage of income.

Typically, the need to ask the client (or "target individual") to reveal his or her present earned income level, so as to have a basic input value for the calculator, is an inherent problem for the salesman. For privacy reasons, most individuals are reluctant to disclose their annual earned income to the salesman.

In a non-analogous field, the calculation of monthly mortgage payments has long been performed using tables having monthly mortgage repayment values expressed in standardized units such as dollars per thousand dollars of principal mortgage amount. These tables allow the calculation of monthly mortgage payments without the need to publish a chart showing all possible values of the principal mortgage amount.

However, in the field of retirement planning, there has not been a reliable way to estimate retirement income without considering the target individual's annual earned income. For that reason, a simple slide-rule-type calculator that bases its retirement income calculations on standardized units which do not necessitate the disclosure of the target individual's annual earned income has been needed for some time.

SUMMARY OF THE INVENTION

The present invention allows a salesman of retirement plans to assess the sufficiency of the target individual's retirement arrangements without any input or recording of his or her annual salary. The invention does so by basing the calculations on "salary replacement values" which represent the percentage of current annual salary that a person will receive annually after retirement, based upon certain present and future considerations. Salary replacement values, which are based upon principles of proportionality, provide a useful retirement forecast that is equally valid across the spectrum of income levels.

Therefore, it is an object of the present invention to provide a retirement calculator for calculating a salary replacement value independent of current salary and to provide a method of calculating a salary replacement value using a retirement calculator.

In accordance with the present invention, the retirement calculator comprises: a sleeve, having an open end; an insert slidably insertable into the open end of said sleeve, said insert having a plurality of age values printed upon said insert, and a plurality of preliminary salary replacement values printed upon said insert; and means for making visible one of said age values and the preliminary salary replacement value corresponding to the visible age value when said insert is positioned in the open end of said sleeve.

In accordance with the present invention, the method of computing a total salary replacement value using a retirement calculator having a sleeve with an age window, a current savings window, and a future contributions window, and an insert with age values, salary replacement values for current savings, and salary replacement values for future contributions printed upon the insert, comprises the steps of estimating a salary replacement value for social security benefits; estimating the ratio of current retirement savings to current annual pre-tax salary; adjusting the insert of the retirement calculator until one of the age values is present in the age window of the sleeve; obtaining a preliminary salary replacement value for current savings corresponding to the age value and a given interest rate from the current savings window of the sleeve; multiplying the preliminary salary replacement value for current savings by the ratio of current retirement savings to current annual salary to obtain an actual salary replacement value for current savings; estimating the percentage of current annual salary to be contributed to retirement savings in the future; obtaining a preliminary salary replacement value for future contributions corresponding to the age value and a given interest rate from the future contributions window on the sleeve; multiplying the preliminary salary replacement value for future contributions by the percentage of current annual pre-tax salary to be contributed to retirement savings in the future to obtain an actual salary replacement value for future contributions; summing the salary replacement value for social security benefits, the actual salary replacement value for current savings, and the actual salary replacement value for future contributions to obtain the total salary replacement value.

BRIEF DESCRIPTION OF THE DRAWINGS

The present invention will be more fully understood by reference to the following detailed description when considered in conjunction with the following drawings wherein like reference numbers denote the same or similar portions or processes shown throughout the several Figures, in which:

FIG. 6 is an illustration of the appearance of the front surface of the jacket;

FIG. 7 is an illustration of the appearance of the back surface of the jacket;

DETAILED DESCRIPTION OF THE INVENTION

Figure 1:
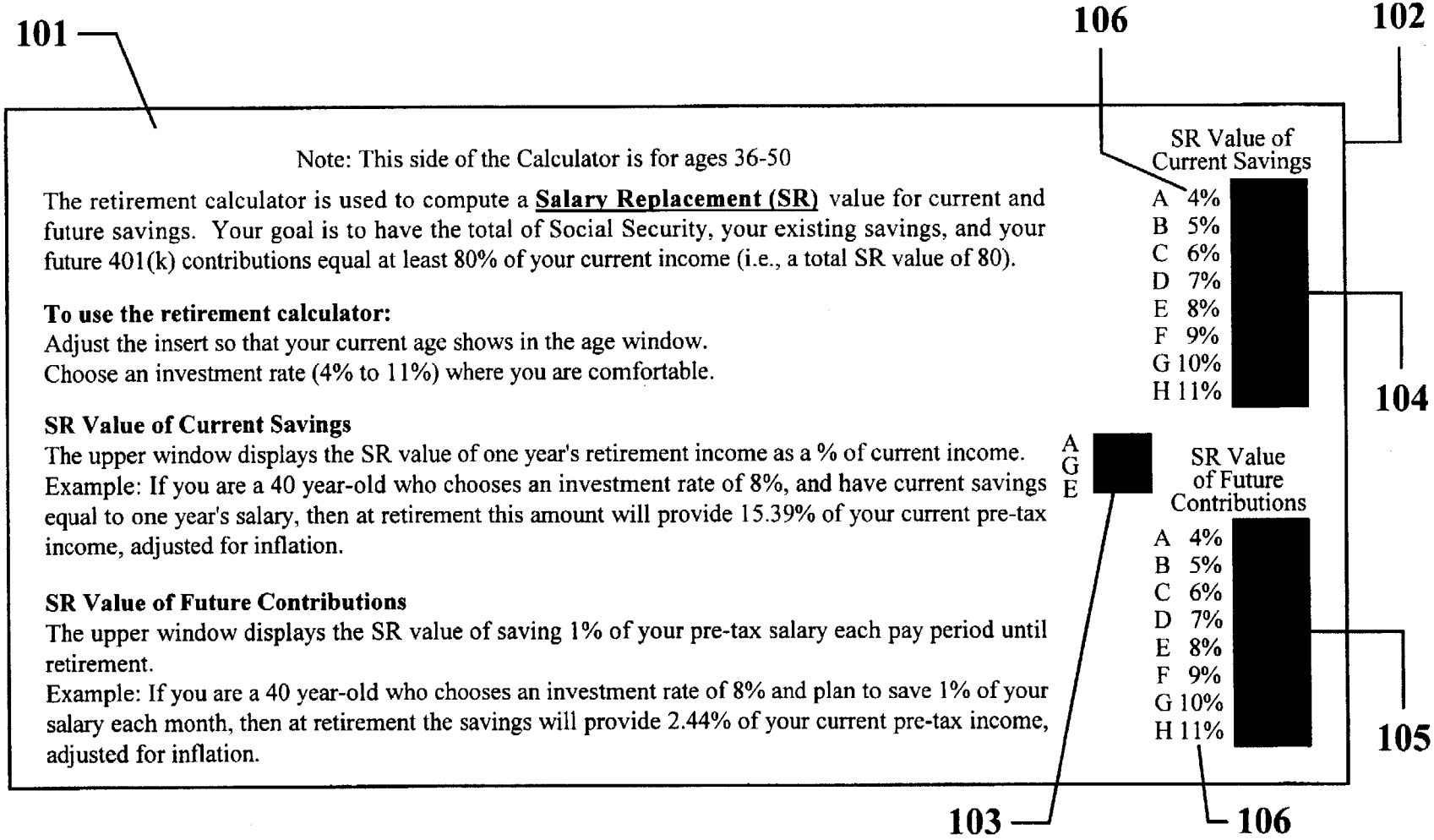
FIG. 1 is an illustration of the appearance of the front surface of the sleeve.

The slide-rule retirement calculator of the present invention comprises a sleeve, an insert, and a jacket. The sleeve may be formed out of a semi-rigid material such as cardboard or plastic and may be one of any number of shapes. In the preferred embodiment of the invention, the sleeve is formed out of cardboard and is rectangular in shape. FIG. 1 illustrates the appearance of the front side of the sleeve 101. The sleeve 101 must have at least one open end 102 so that the insert can be inserted into the sleeve 101. In the preferred embodiment of the invention, the sleeve 101 has two open ends 102 opposite one another so as to allow the insert to pass completely through the sleeve 101.

In addition, the front side of the sleeve 101 has a cutout area, which, in the preferred embodiment, is made up of three rectangular non-contiguous openings. The openings, hereinafter referred to as "windows," are represented in FIG. 1 by the darkened areas. These windows allow text printed on the insert to be visible when the insert is inserted or positioned inside the sleeve. The leftmost window 103 depicted in FIG. 1 will hereinafter be referred to as the "age window" 103. The window 104 depicted in the upper right portion of FIG. 1 will hereinafter be referred to as the "current savings window" 104. The window 105 depicted in the lower right portion of FIG. 1 will hereinafter be referred to as the "future contributions window" 105. In the preferred embodiment of the invention, there are also eight interest rate values 106, ranging from four to eleven percent, printed on the front side of the sleeve 101 adjacent the current savings window 104 and the future contributions window 105.

Figure 2:
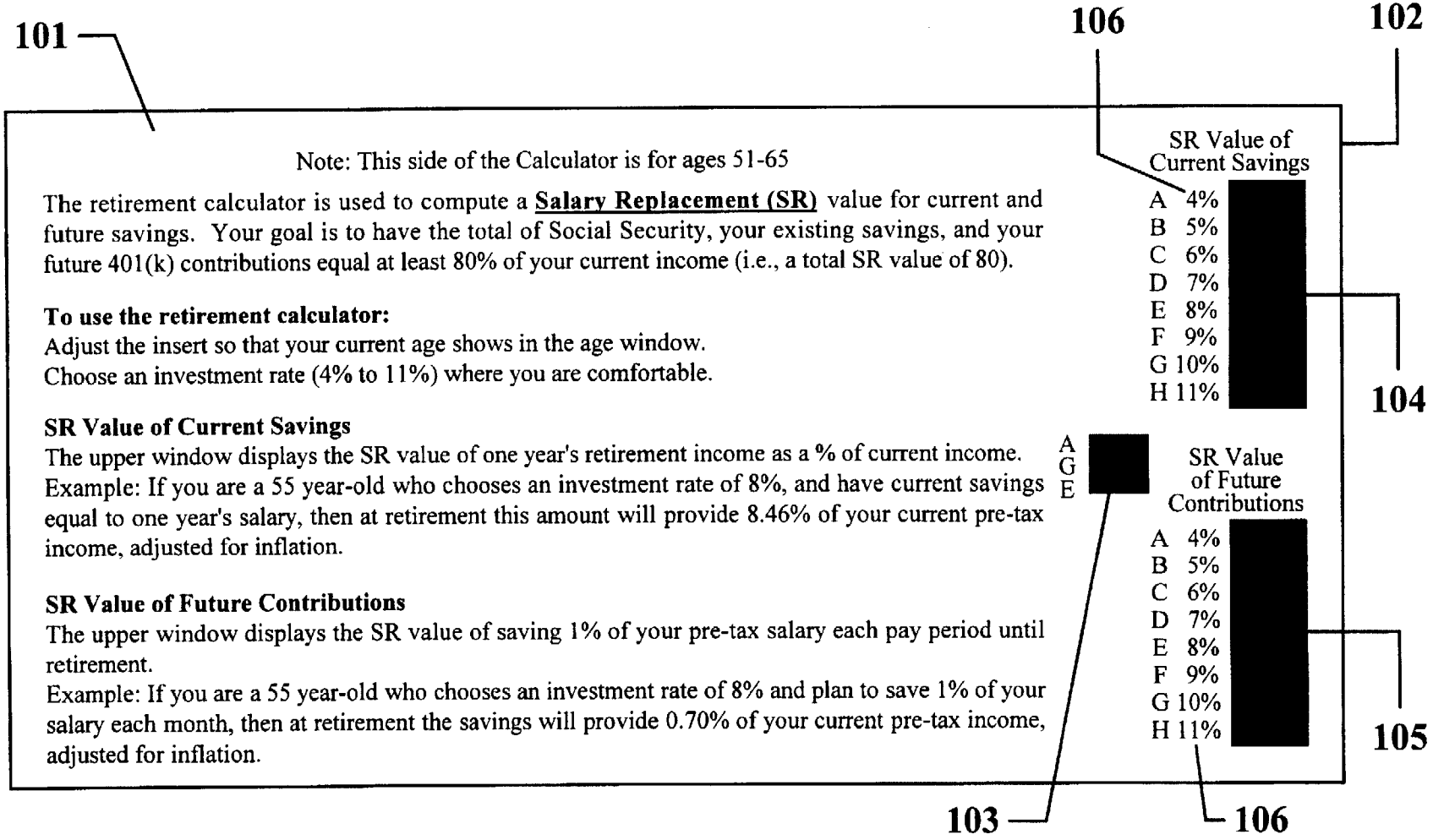
FIG. 2 is an illustration of the appearance of the back surface of the sleeve.

FIG. 2 illustrates the appearance of the back side of the sleeve 101. In the preferred embodiment of the invention, the back side is substantially similar in appearance to the front side of the sleeve 101, and likewise contains an age window 103, a current savings window 104, a future contributions window 105, and printed interest rate values 106, all in the same configuration as on the front side.

Figure 3:
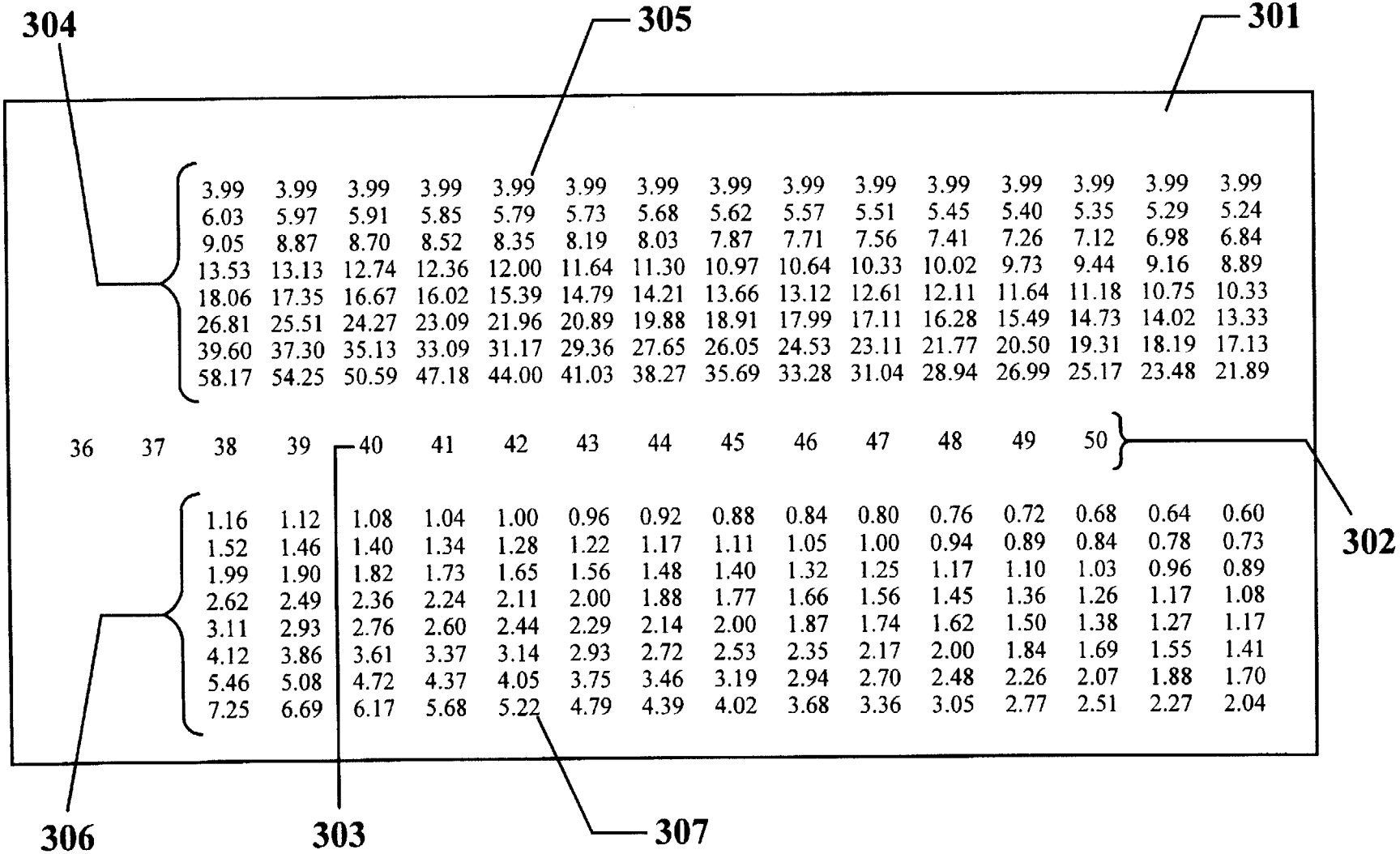
FIG. 3 is an illustration of the appearance of the front surface of the insert.

FIG. 3 illustrates the appearance of the front side of the insert 301. In the preferred embodiment of the invention, the insert 301 is formed out of cardboard and is of a shape and size such that it is insertable into an open end 102 of the sleeve 101. The insert 301 has printed upon it a central row 302 of numbers 303 representing the range of ages of the user of the retirement calculator. This row 302 will be hereinafter referred to as the "age row" 302. The numbers 303 making up the age row 302 will be hereinafter referred to as "age values" 303. Although not shown in FIG. 3, in the preferred embodiment of the invention, the age values 303 in the age row 302 printed on the front side of the insert 301 range from twenty to forty-two years.

Above the age row 302, are eight rows 304 of numbers 305 representing preliminary salary replacement (SR) values for current savings. Each preliminary SR value for current savings 305 corresponds to one of the age values 303 and one of the interest rates 106 printed on the sleeve 101 adjacent the current savings window 104. Each preliminary SR value for current savings 305 represents the percentage of current annual salary, adjusted for inflation, that a person of the corresponding age who has current retirement savings in an amount equal to his current annual salary can anticipate receiving annually after retirement from returns on his current retirement savings, assuming that he collects interest in the future at the corresponding interest rate. A preliminary SR value for current savings 305 provides a standard multiplier which can be multiplied by the ratio of a person's actual retirement savings to his current annual salary to obtain an actual salary replacement value for current savings.

Preliminary SR values for current savings can be calculated in the following manner. For uniformity, it is assumed that the person will retire at age sixty-five and will not live past the age of ninety (the retirement period is therefore twenty-five years, or three hundred months), that the annual inflation rate and the annual salary increase rate will be four percent in the future, and that the post-retirement interest rate will be one percent per annum less than pre-retirement interest rates of eight percent or more. A person having ordinary skill in the art will realize that other assumptions could be employed to obtain equally valid preliminary salary replacement values for current savings. Since the result of the calculation is to be expressed as a percent of current income assuming that current retirement savings equal one-hundred percent of one year's salary, the value which is used to represent current retirement savings in the calculation is one-hundred.

The first step in calculating a preliminary SR value for current savings is to compute the value, in today's dollars, of current retirement savings at the time of retirement, assuming monthly payment and reinvestment of any gains on the balance. This computation can be expressed as the following formula:

$$\text{value at retirement} = \text{current retirement savings} \times (1 + \text{pre-retirement monthly interest rate} - \text{monthly inflation rate})^{(\text{number of months to retirement})}$$

The last step is to compute the value of the monthly income stream which reduces the value at retirement computed with the above formula to zero at the end of the retirement period, assuming monthly withdrawals and monthly compounding of the balance. This is an iterative process. Beginning with the value at retirement and an estimated monthly income stream amount, the balance remaining each month is computed using the following formula:

$$\text{new balance}=(\text{old balance}-\text{monthly income stream amount})\times(1+\text{post-retirement monthly interest rate}-\text{monthly inflation rate})$$

If the balance reaches zero prior to the end of the retirement period, the monthly income stream amount is decreased and another iteration is performed. If the balance is still positive at the end of the retirement period, the monthly income stream mount is increased and another iteration is performed. This continues until the balance is zero at the end of the retirement period. When that point is reached, the preliminary SR value for current savings for the particular age and interest rate is equal to the final monthly income stream amount multiplied by twelve. Below the age row 302, are eight additional rows 306 of numbers 307 representing preliminary salary replacement (SR) values for future contributions. Each preliminary SR value for future contributions 307 corresponds to one of the age values 303 and one of the interest rates 106 printed on the sleeve 101 adjacent the future contributions window 105. Each preliminary SR value for future contributions 307 represents the percentage of current annual salary, adjusted for inflation, that a person of the corresponding age who will contribute one percent of his annual salary to retirement savings in the future, can anticipate receiving annually after retirement, from returns on those future contributions, assuming that he collects interest in the future at the corresponding interest rate. A preliminary SR value for future contributions 307 provides a standard multiplier which can be multiplied by the actual percentage of current annual salary to be contributed to retirement savings in the future to obtain an actual salary replacement value for current savings.

Preliminary SR values for future contributions can be calculated in the following manner. Again for uniformity, it is assumed that the person will retire at age sixty-five and will not live past the age of ninety (the retirement period is therefore twenty-five years, or three hundred months), that the annual inflation rate and the annual salary increase rate will be four percent in the future, and that the post-retirement interest rate will be one percent per annum less than pre-retirement interest rates of eight percent or more. A person having ordinary skill in the art will realize that other assumptions could be employed to obtain equally valid preliminary salary replacement values for future contributions. Since the result of the calculation is to be expressed as a percent of current income assuming that future contributions to retirement savings equal one percent of one year's salary, the value which is used to represent each future contribution in the calculation is one.

The first step in calculating a preliminary SR value for future contributions is to compute the value at the time of retirement, in today's dollars, of each future contribution to retirement savings, assuming monthly payment and reinvestment of any gains on the contribution. This computation can be expressed as the following formula:

$$\text{value of contribution at retirement}=\text{monthly contribution}\times(1+\text{pre-retirement monthly interest rate}-\text{monthly inflation rate})^{(\text{number of months from contribution to retirement})}$$

All of these values are then summed to obtain a total value at retirement for future contributions.

The last step is to compute the value of the monthly income stream which reduces the value at retirement computed above to zero at the end of the retirement period, assuming monthly withdrawals and monthly compounding of the balance. Again, this is an iterative process. Beginning with the value at retirement and an estimated monthly income stream amount, the balance remaining each month is computed using the following formula:

$$\text{new balance}=(\text{old balance}-\text{monthly income stream amount})\times(1+\text{post-retirement monthly interest rate}-\text{monthly inflation rate})$$

If the balance reaches zero prior to the end of the retirement period, the monthly income stream amount is decreased and another iteration is performed. If the balance is still positive at the end of the retirement period, the monthly income stream amount is increased and another iteration is performed. This continues until the balance is zero at the end of the retirement period. When that point is reached, the preliminary SR value for future contributions for the particular age and interest rate is equal to the final monthly income stream amount multiplied by twelve.

Preliminary SR values for current savings and preliminary SR values for future contributions may be referred to generically as "preliminary salary replacement values." Any variable which may be used in the calculation of preliminary salary replacement values may be referred to as a "primary salary replacement variable" or a "secondary salary replacement variable." These variables include, without limitation, current age, age of retirement, age of death, interest rate, annual inflation rate, and annual salary increase rate.

In the preferred embodiment of the invention, all of the rows discussed above are horizontally positioned. The numbers making up the rows could, however, be arranged in a vertical columnar fashion. Therefore, for the purposes of this description, the term "row" is meant to encompass both horizontal and vertical arrangements.

Figure 4:
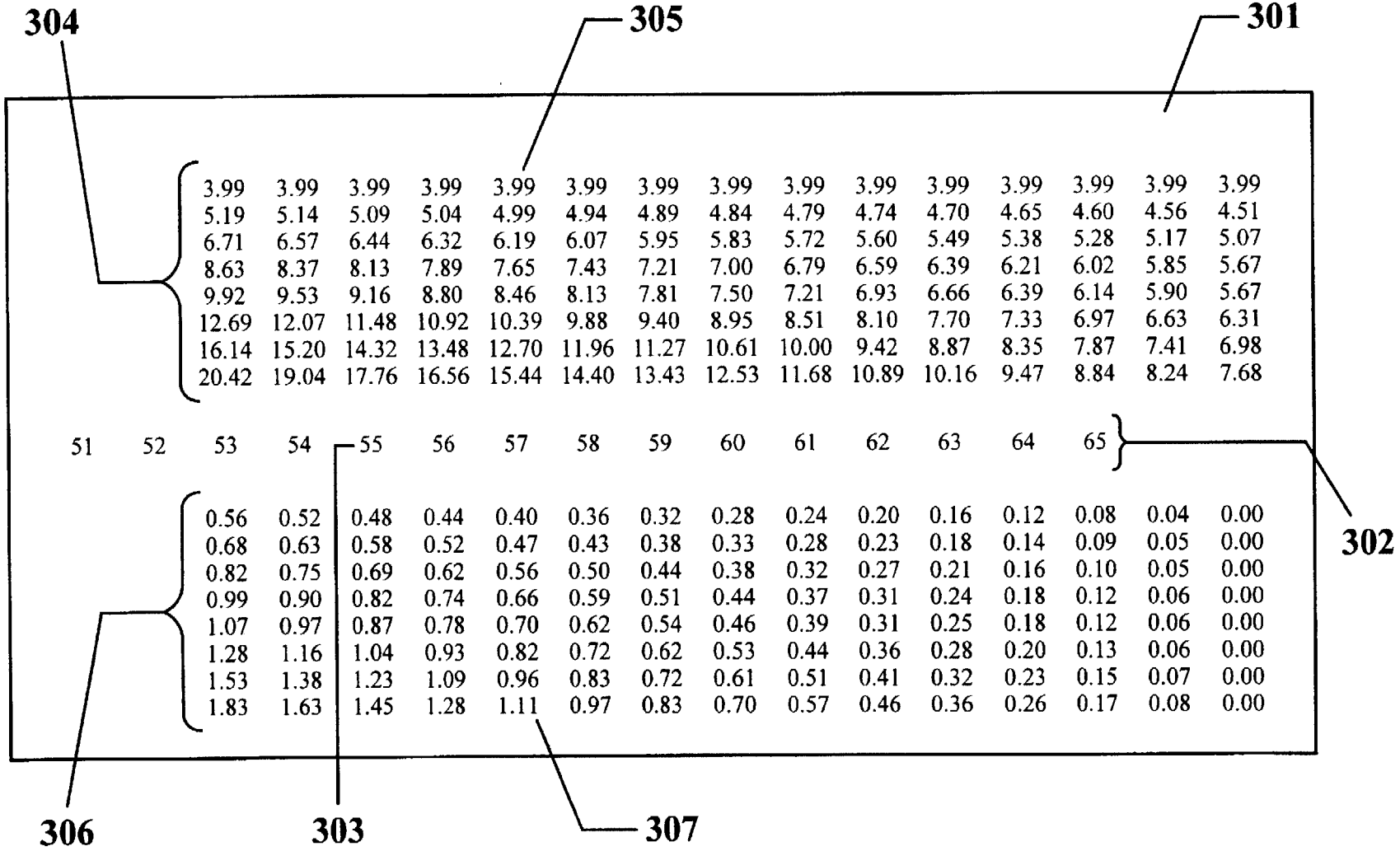
FIG. 4 is an illustration of the appearance of the back surface of the insert.

FIG. 4 illustrates the appearance of the back side of the insert 301. In the preferred embodiment of the invention, the back side is substantially similar in appearance to the front side of the insert 301, and likewise has printed upon it an age row 302, eight rows 304 of preliminary SR values for current savings 305, and eight rows 306 of preliminary SR values for future contributions 307. Although not shown in FIG. 4, preferably the age values 303 in the age row 302 printed on the back side of the insert 301 range from forty three to sixty-five. The preliminary SR values for current savings 305 and the preliminary SR values for future contributions 307 printed on the back side of the insert 301 correspond to the age values 304 printed on the back of the insert 301.

Figure 5:
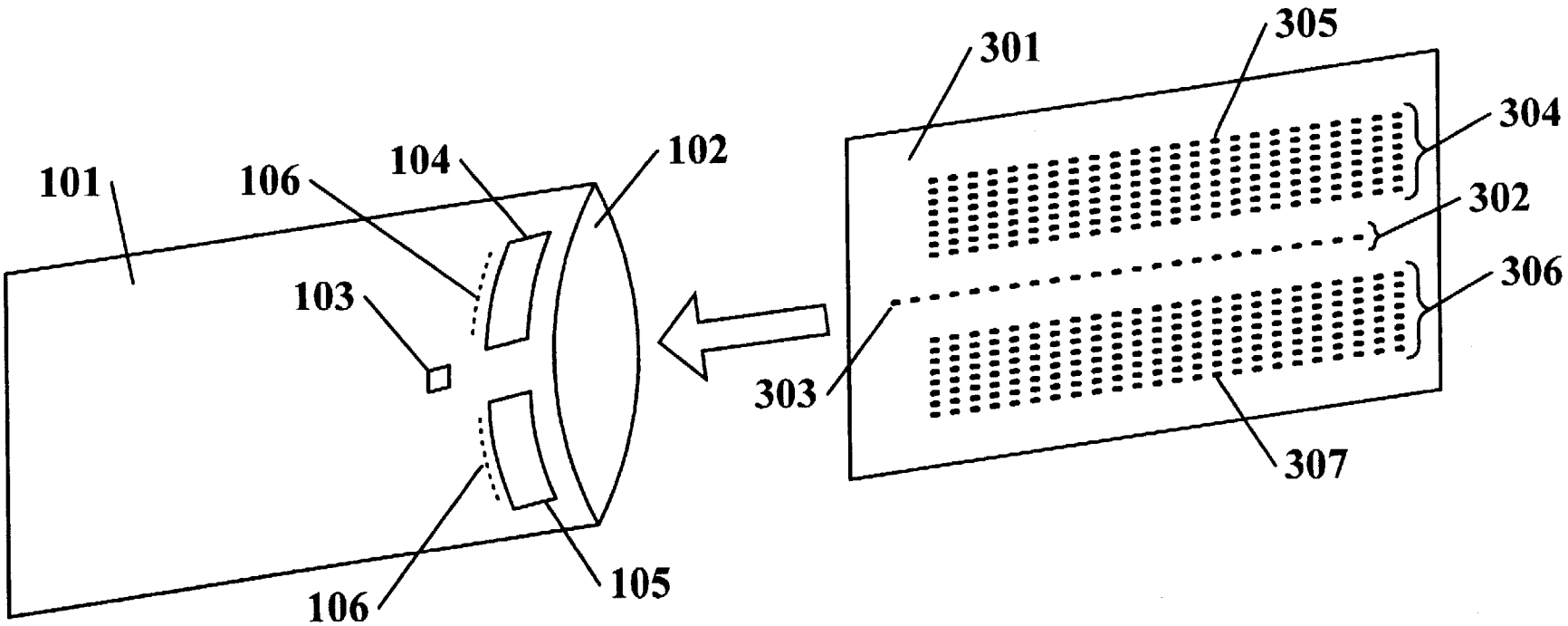
FIG. 5 is an illustration of the insertion of the insert into the sleeve.

FIG. 5 illustrates the insertion of the insert 301 into the sleeve 101 through an open end 102. When the insert 301 is positioned inside the sleeve 101, one of the age values 303 in the age row 302 can be seen through the age window 103 on the sleeve 101. Similarly, eight preliminary SR values for current savings 305, each from a different row 304, can be seen through the current savings window 104 on the sleeve 101. The preliminary SR values for current savings 305 are arranged on the insert 301 so that the eight preliminary SR values for current savings 305 visible in the current savings window 104 correspond to the eight interest rate values 106 printed next to the current savings window 104 and to the age value 303 visible in the age window 103.

Likewise, eight preliminary SR values for future contributions 307, each from a different row 306, can be seen through the future contributions window 105 on the sleeve 101. The preliminary SR values for future contributions 307 are arranged on the insert 301 so that the eight preliminary SR values for future contributions 307 visible in the future contributions window 105 correspond to the eight interest rate values 106 printed next to the future contributions window 105 and to the age value 303 visible in the age window 103.

The jacket 601 (FIGS. 6 and 7) is a pocket with an internal space and an open end 602, for sliding the sleeve 101, with the insert 301 inside, into the internal space for storage. In the preferred embodiment of the invention, the jacket 601 is formed out of paper and is of a shape and size such that the sleeve 101 is insertable into the open end 602 of the jacket 601. FIG. 6 illustrates the appearance of the front side of the jacket 601. Printed upon the front side of the jacket 601 is a social security benefits table 603 which is used to estimate the salary replacement value for social security benefits based upon current age and salary. The contents of the social security benefits table 603 can be obtained from the United States Social Security Administration or by referring to page 197 of the book entitled *Escaping the Coming Retirement Crisis*, by R. Theodore Benna and William Proctor, Copyright 1995, Pinon Press, which is hereby incorporated by reference as though fully reproduced herein. Also printed upon the front side of the jacket 601 is a portfolio allocation table 604 which shows the mix of assets historically needed to achieve rates of return on investments ranging from four to eleven percent per annum. FIG. 7 illustrates the appearance of the back side of the jacket 601. Printed upon the back side of the jacket is a worksheet 709 setting forth a method of calculating a total salary replacement value. The total salary replacement value is the percentage of current annual salary, adjusted for inflation, that a person can anticipate receiving annually from all retirement sources, including social security benefits, current retirement savings, and future contributions to retirement savings.

The following is an example calculation, using the worksheet 709, of the total salary replacement value of a hypothetical forty year-old person. It will be presumed that the hypothetical forty year-old has a mix of assets that will likely earn a rate of return of eight percent per annum according to the portfolio allocation table 604 printed on the front side of the jacket 601. The first box 701 on the worksheet 709 is to be filled in with an estimate of the salary replacement value for social security benefits obtained from the social security benefits table 603 printed on the front side of the jacket 601. For the purposes of this example calculation, it will be presumed that the current annual salary of our hypothetical forty year-old is such that his salary replacement value for social security benefits is thirty-one percent according to the social security benefits table 603. Thus, "31" would be entered in the first box 701 of the worksheet 709.

The next box 702 on the worksheet 709 is to be filled in with an estimate of the ratio of current retirement savings to current annual salary. Again, for the purposes of this example, it will be presumed that our hypothetical forty year-old has current retirement savings in an amount equal to "2.4" times his current annual salary. Thus, "2.4" would be entered in the second box 702 of the worksheet 709.

Figure 8:
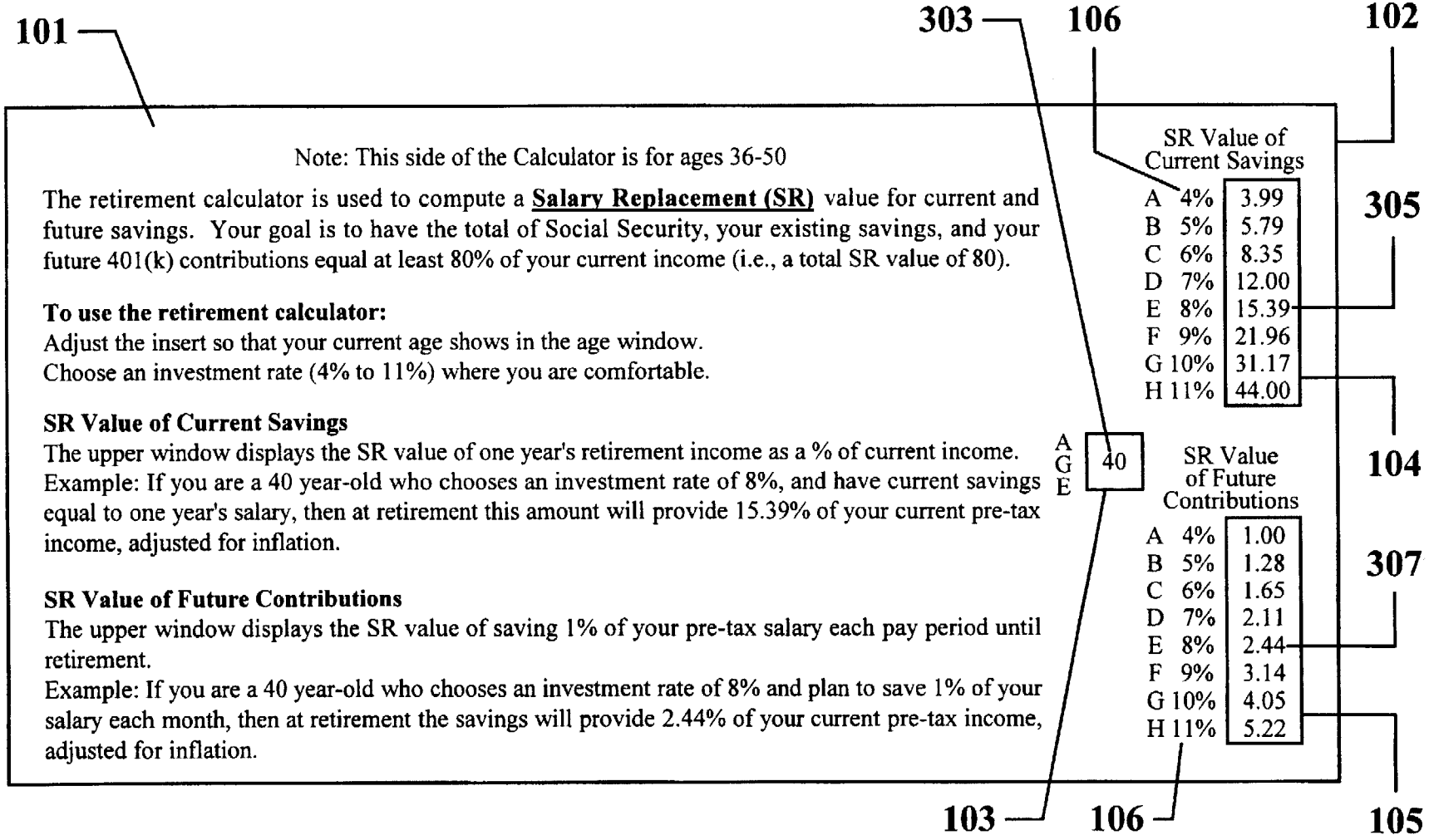
FIG. 8 is an illustration of the front surface of the sleeve with the insert positioned inside the sleeve.

Next, a preliminary salary replacement value for current savings is obtained by placing the insert in the open end of the sleeve 101 and adjusting the insert 301 until the age value 303 visible in the age window 103 is the correct age, in our case, forty. FIG. 8 illustrates the appearance of the front side of the sleeve 101 with the insert 301 positioned inside and adjusted so that the age value 303 visible in the age window 103 is "40." With the insert 301 properly adjusted, eight preliminary SR values for current savings 305 are visible in the current savings window 104. Since our hypothetical forty year-old will likely earn eight percent on his investments, his preliminary salary replacement value for current savings will be the preliminary SR value for current savings 305 visible in the current savings window 104 next to the eight percent interest rate value 106, or "15.39". Thus, "15.39" would be entered in the third box 703 of the worksheet 709. The product of multiplying the numbers entered in the second 702 and third 703 boxes of the worksheet is then entered in the fourth box 704. This product or value, which turns out to be "36.94", is the actual salary replacement value for current savings.

The next box 705 on the worksheet 709 is to be filled in with the percentage of annual salary to be contributed yearly towards retirement savings in the future. For the purposes of this example, it will be presumed that our hypothetical forty year-old plans to contribute five percent of his annual salary towards retirement savings in the future. Thus, "5" would be entered in the fifth box 705 of the worksheet 709.

Next, a preliminary salary replacement value for future contributions is obtained. After adjusting the insert 301 within the sleeve 101 so that the age value 303 visible in the age window 103 is "40", eight preliminary SR values for future contributions 307 are visible in the future contributions window 105. Since our hypothetical forty year-old will likely earn eight percent on his investments, his preliminary salary replacement value for future contributions will be the preliminary SR value for future contributions 307 visible in the future contributions window 105 next to the eight percent interest rate value 106, or "2.44". Thus, "2.44" would be entered in the sixth box 706 of the worksheet 709. The product of multiplying the numbers entered in the fifth 705 and sixth 706 boxes of the worksheet is then entered in the seventh box 707. This product or value, which turns out to be "12.2", is the actual salary replacement value for future contributions.

The total salary replacement value can then be obtained by summing the values entered in the first 701, fourth 704, and seventh 707 boxes of the worksheet 709. Summing these values yields a value of 80.14% (31%+36.94%+12.2%=80.14%). This value, which would be entered in box eight 708, represents the percentage of current annual salary, adjusted for inflation, that our hypothetical forty year-old can anticipate receiving annually upon retirement, assuming that he retires at age sixty-five and does not live past the age of ninety. It is customarily suggested that a total salary replacement value of eighty percent be targeted. Since our hypothetical forty year-old has a total salary replacement value of 80.14%, his retirement plans appear to be sufficient.

Figure 9:
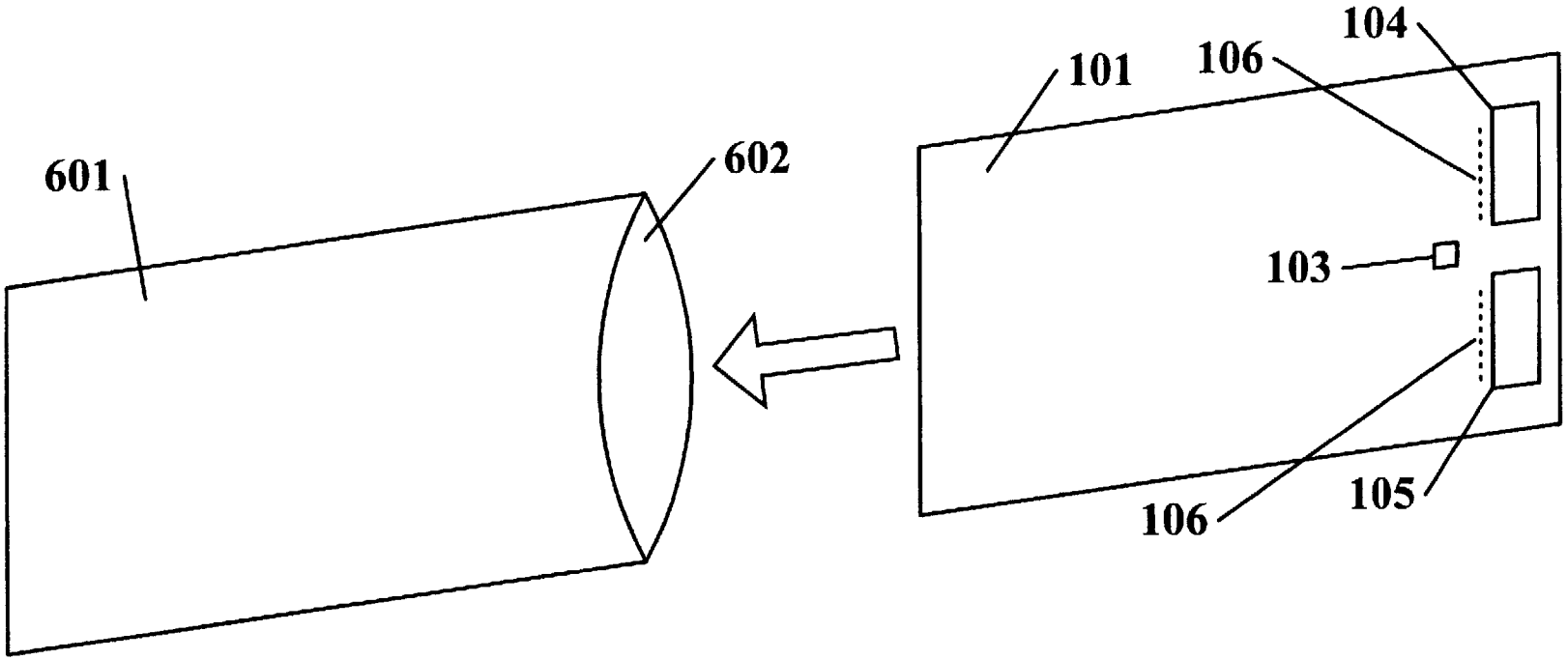
FIG. 9 is an illustration of the insertion of the sleeve into the jacket.

Once the calculation of the total salary replacement value is completed, the sleeve 101, with the insert 301 inside, can be inserted into the open end 602 of the jacket 601 for storage. FIG. 9 illustrates the insertion of the sleeve 101 into the open end 602 of the jacket 601.

Figure 10:
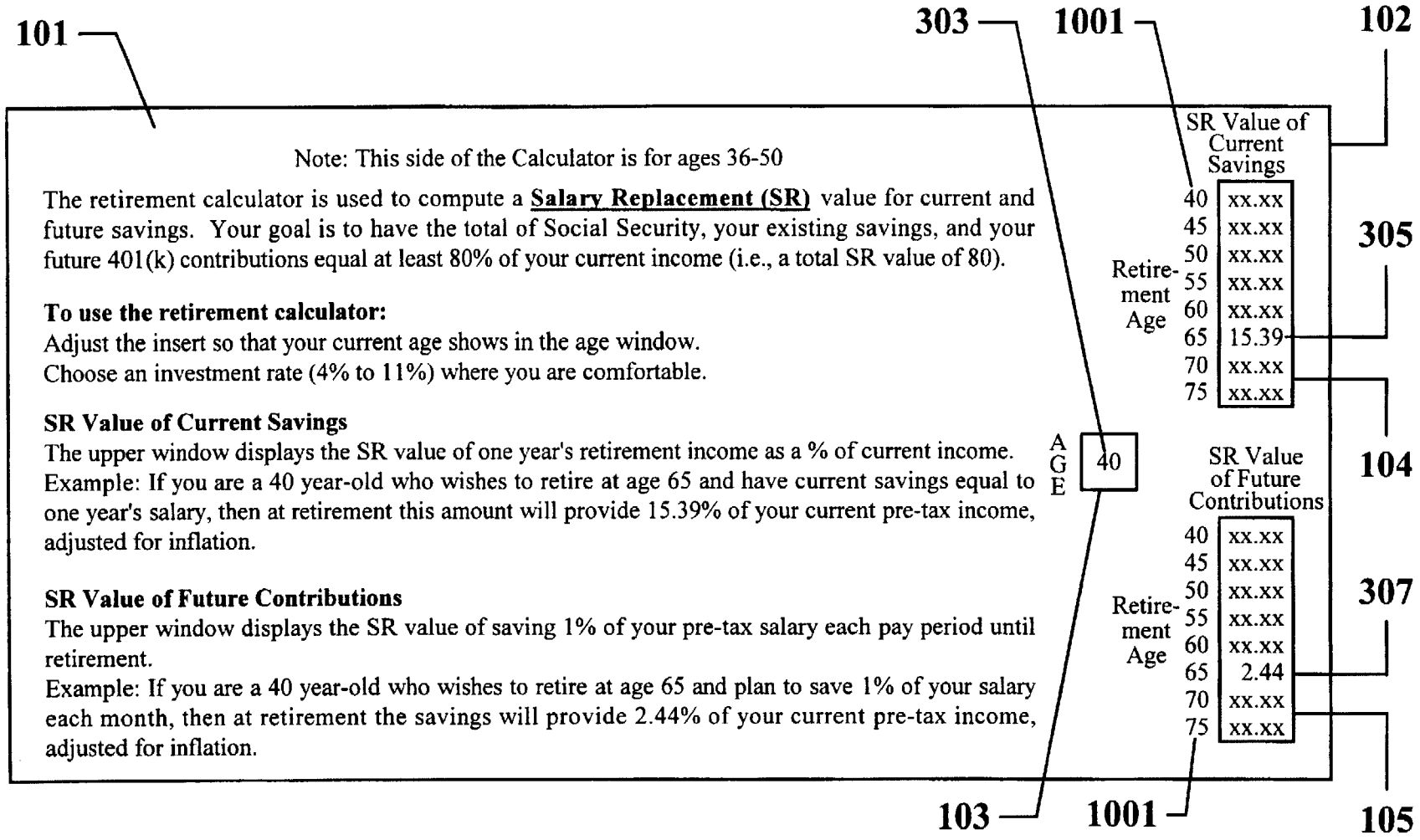
FIG. 10 is an illustration of a second embodiment of the sleeve and insert arrangement.

An alternative embodiment of the sleeve and insert arrangement is depicted in FIG. 10. In this embodiment, there are eight retirement age values 1001, instead of interest rate values 106, printed on the sleeve 101 adjacent the current savings 104 and future contributions windows 105. The preliminary SR values for current savings 305 and the preliminary SR values for future contributions 307 printed upon the insert 301 are calculated using the formulas discussed above, wherein the interest rate is presumed to be fixed at eight percent and the age of retirement falls into the range of retirement age values 1001 printed on the insert 301.

The preliminary SR values for current savings 305 and the preliminary SR values for future contributions 307 are then arranged on the insert 301 so that the eight preliminary SR values for current savings 305 visible in the current savings window 103 correspond to the eight retirement age values 1001 printed next to the current savings window 105 and to the age value 303 visible in the age window 103 and the preliminary SR values for future contributions 307 visible in the future contributions window 105 correspond to the eight retirement age values 1001 printed next to the future contributions window 105 and to the age value 303 visible in the age window 103.

After the preliminary SR value for current savings and the preliminary SR value for future contributions have been obtained, the calculation of the actual salary replacement value for current savings, the actual salary replacement value for future contributions, and, ultimately, the total salary replacement value proceeds as set forth in the worksheet 709 printed on the back side of the jacket 601 described above.

Figure 11:
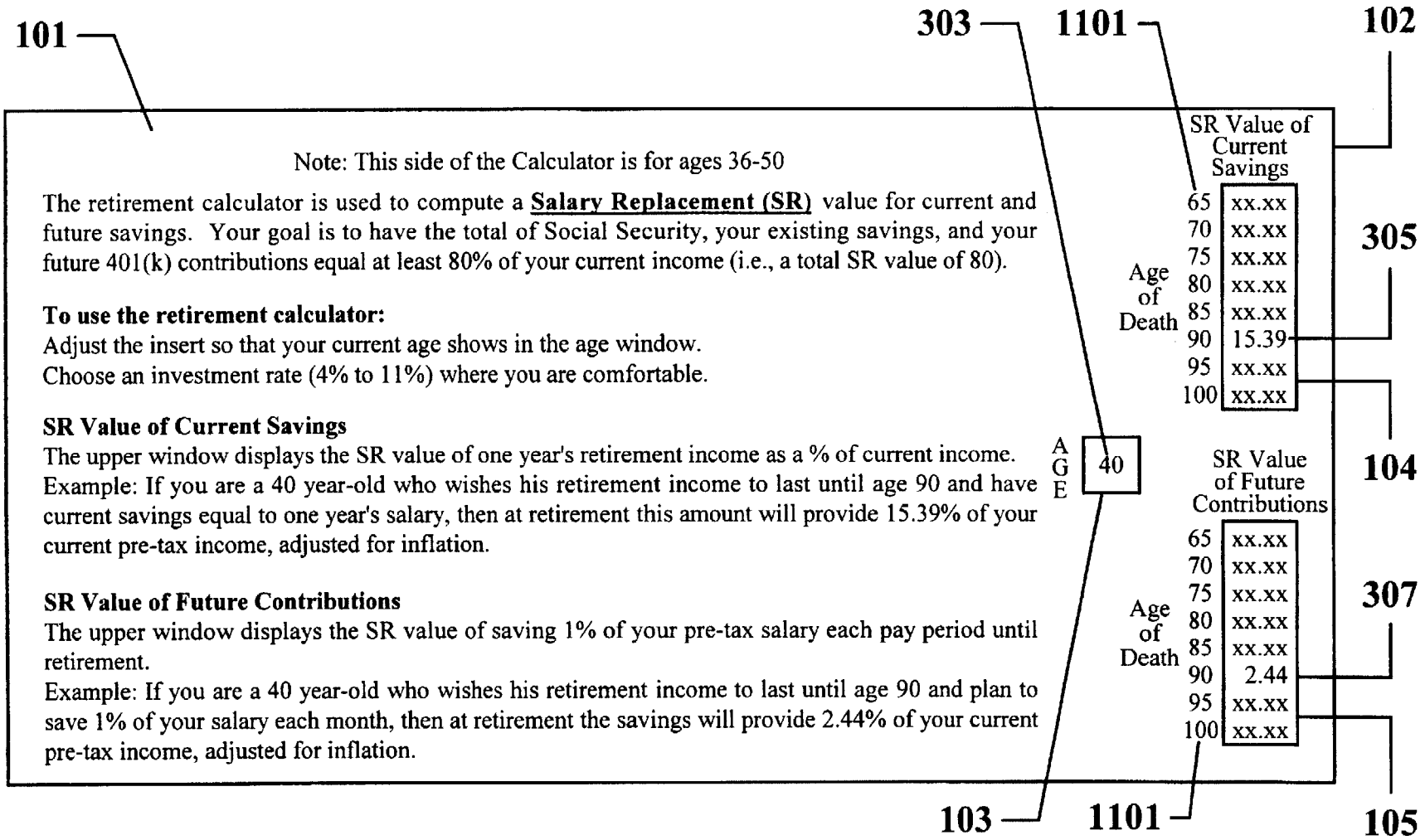
FIG. 11 is an illustration of a third embodiment of the sleeve and insert arrangement.

Yet another alternative embodiment of the sleeve and insert arrangement is depicted in FIG. 11. In this embodiment, there are eight age of death values 1101, instead of interest rate values 106, printed on the sleeve 101 adjacent the current savings 104 and future contributions windows 105. The preliminary SR values for current savings 305 and the preliminary SR values for future contributions 307 printed upon the insert 301 are calculated using the formulas discussed above, wherein the interest rate is presumed to be fixed at eight percent and the age of death falls into the range of age of death values 1101 printed on the insert 301.

The preliminary SR values for current savings 305 and the preliminary SR values for future contributions 307 are then arranged on the insert 301 so that the eight preliminary SR values for current savings 305 visible in the current savings window 103 correspond to the eight age of death values 1101 printed next to the current savings window 105 and to the age value 303 visible in the age window 103 and the preliminary SR values for future contributions 307 visible in the future contributions window 105 correspond to the eight age of death values 1101 printed next to the future contributions window 105 and to the age value 303 visible in the age window 103.

After the preliminary SR value for current savings and the preliminary SR value for future contributions have been obtained, the calculation of the actual salary replacement value for current savings, the actual salary replacement value for future contributions, and, ultimately, the total salary replacement value proceeds as set forth in the worksheet 709 printed on the back side of the jacket 601 described above.

While the retirement calculator apparatus and method of computing a total salary replacement value herein described constitute the preferred embodiments of the present invention, it is to be understood that the invention is not limited to the precise form of apparatus or the precise steps of the method, respectively, and that changes may be made therein without departing from the scope of the invention which is defined in the appended claims.

We claim:

1. A retirement calculator for computing a salary replacement value independent of current salary, comprising:

a sleeve, having an open end and a cutout area;

an insert slidably insertable into the open end of said sleeve, said insert having:

a plurality of age values printed upon said insert, and a plurality of preliminary salary replacement values printed upon said insert;

wherein said age values and said preliminary salary replacement values are arranged upon said insert such that when said insert is positioned in the open end of said sleeve, one of said plurality of age values and the corresponding preliminary salary replacement value are visible through said cutout area.

2. A retirement calculator as recited in claim 1, wherein said preliminary salary replacement values represent preliminary salary replacement values for current savings.

3. A retirement calculator as recited in claim 2, further comprising:

a plurality of preliminary salary replacement values for future contributions printed upon said insert; and means for making visible the preliminary salary replacement value for future contributions corresponding to the visible age value when said insert is positioned in the open end of said sleeve.

4. A retirement calculator as recited in claim 1, wherein said preliminary salary replacement values represent preliminary salary replacement values for future contributions.

5. A retirement calculator as recited in claim 1, wherein said preliminary salary replacement values printed on said insert represent projected retirement income as a percentage of current salary.

6. A retirement calculator as recited in claim 1, further comprising:

a jacket having:

an open end, and a social security benefits table printed upon said jacket for estimating the salary replacement value for social security benefits;

said sleeve being slidably insertable into the open end of said jacket.

7. A retirement calculator as recited in claim 6, wherein said jacket has printed upon it a worksheet for calculating a total salary replacement value.

8. A retirement calculator as recited in claim 1, wherein:

said sleeve has a front side and a back side, each having a cutout area;

said insert has a front side and a back side;

a portion of said age values and the corresponding salary replacement values are printed upon the front side of said insert and the remaining portion of said age values and the corresponding salary replacement values are printed upon the back side of said insert;

the age values and the preliminary salary replacement values printed on the front side of said insert are arranged such that when said insert is positioned in the open end of said sleeve, one of said plurality of age values and the corresponding preliminary salary replacement value are visible through the cutout area on the front side of said sleeve; and the age values and the preliminary salary replacement values printed on the back side of said insert are arranged such that when said insert is positioned in the open end of said sleeve, one of said plurality of age values and the corresponding preliminary salary replacement value are visible through the cutout area on the back side of said sleeve.

9. A retirement calculator as recited in claim 8, wherein said preliminary salary replacement values represent preliminary salary replacement values for current savings.

10. A retirement calculator as recited in claim 9, wherein:

said insert has a plurality of preliminary salary replacement values for future contributions printed upon its front and back sides;

said preliminary salary replacement values for future contributions printed on the front side of said insert are arranged such that when said insert is positioned in the open end of said sleeve, the preliminary salary replacement value for future contributions corresponding to the age value visible through the cutout area on the front side of said sleeve is visible through the cutout area on the front side of said sleeve; and said preliminary salary replacement values for future contributions printed on the back side of said insert are arranged such that when said insert is positioned in the open end of said sleeve, the preliminary salary replacement value for future contributions corresponding to the age value visible through the cutout area on the back side of said sleeve is visible through the cutout area on the back side of said sleeve.

11. A retirement calculator as recited in claim 8, wherein said preliminary salary replacement values represent preliminary salary replacement values for future contributions.

12. A retirement calculator as recited in claim 8, wherein said preliminary salary replacement values printed on said insert represent projected retirement income as a percentage of current salary.

13. A retirement calculator as recited in claim 8, wherein:

said sleeve has at least one interest rate value printed on each side adjacent said cutout area; and said interest rate value corresponds to both the age value visible in said cutout area and to the preliminary salary replacement value visible in said cutout area immediately adjacent the interest rate value.

14. A retirement calculator as recited in claim 8, further comprising:

a jacket having:

an open end, and a social security benefits table printed upon said jacket for estimating the salary replacement value for social security benefits;

said sleeve being slidably insertable into the open end of said jacket.

15. A retirement calculator as recited in claim 14, wherein said jacket has printed upon it a worksheet for calculating a total salary replacement value.

16. A retirement calculator as recited in claim 1, wherein:

said means for making visible one of said age values and the preliminary salary replacement value corresponding to the visible age value when said insert is positioned in the open end of said sleeve includes first and second windows on said sleeve;

said age values and said preliminary salary replacement values being arranged upon said insert such that when said insert is positioned in the open end of said sleeve:

one of said plurality of age values is visible through said first window, and the preliminary salary replacement value corresponding to the age value visible in the first window of said sleeve is visible in said second window.

17. A retirement calculator as recited in claim 16, wherein said preliminary salary replacement values represent preliminary salary replacement values for current savings.

18. A retirement calculator as recited in claim 17, further comprising:

a plurality of preliminary salary replacement values for future contributions printed upon said insert;

said sleeve having a third window; and said preliminary salary replacement values for future contributions being arranged on said insert such that when said insert is positioned in the open end of said sleeve, the preliminary salary replacement value for future contributions corresponding to the age value visible in said first window is visible in said third window.

19. A retirement calculator as recited in claim 16, wherein said preliminary salary replacement values represent preliminary salary replacement values for future contributions.

20. A retirement calculator as recited in claim 16, wherein said preliminary salary replacement values printed on said insert represent projected retirement income as a percentage of current salary.

21. A retirement calculator as recited in claim 16, wherein:

said sleeve has at least one interest rate value printed on said sleeve adjacent said second window; and said interest rate value corresponds to both the age value visible in said first window and to the preliminary salary replacement value visible in said second window immediately adjacent the interest rate value.

22. A retirement calculator as recited in claim 16, further comprising:

a jacket having:

an open end, and a social security benefits table printed upon said jacket for estimating the salary replacement value for social security benefits;

said sleeve being slidably insertable into the open end of said jacket.

23. A retirement calculator as recited in claim 22, wherein said jacket has printed upon it a worksheet for calculating a total salary replacement value.

24. A method of computing a total salary replacement value using a retirement calculator having a sleeve with an age window, a current savings window, and a future contributions window, and an insert with age values, preliminary salary replacement values for current savings, and preliminary salary replacement values for future contributions printed upon the insert, comprising the steps of:

estimating a salary replacement value for social security benefits;

estimating the ratio of current retirement savings to current annual pre-tax salary;

adjusting the insert of the retirement calculator until one of the age values is visible in the age window of the sleeve;

obtaining a preliminary salary replacement value for current savings corresponding to the age value and a given interest rate from the current savings window of the sleeve;

multiplying the preliminary salary replacement value for current savings by the ratio of current retirement savings to current annual salary to obtain an actual salary replacement value for current savings;

estimating the percentage of current annual salary to be contributed to retirement savings in the future;

obtaining a preliminary salary replacement value for future contributions corresponding to the age value and a given interest rate from the future contributions window on the sleeve;

multiplying the preliminary salary replacement value for future contributions by the percentage of current annual pre-tax salary to be contributed to retirement savings in the future to obtain an actual salary replacement value for future contributions; and summing the salary replacement value for social security benefits, the actual salary replacement value for current savings, and the actual salary replacement value for future contributions to obtain the total salary replacement value.

25. A retirement calculator for computing a salary replacement value independent of current salary, comprising:

an insert having:

a plurality of primary salary replacement variables printed upon said insert, and a plurality of preliminary salary replacement values printed upon said insert; and a sleeve having:

an open end adapted to receive said insert, a cutout area, and a plurality of secondary salary replacement variables printed upon said sleeve adjacent said cutout area;

said primary salary replacement variables and said preliminary salary replacement values being arranged upon said insert such that when said insert is positioned in the open end of said sleeve, at least one of said primary salary replacement variables and at least one of said preliminary salary replacement values is visible in said cutout area; and said visible preliminary salary replacement value corresponding to the visible primary salary replacement variable and to the secondary salary replacement variable printed on said sleeve immediately adjacent the visible preliminary salary replacement value.

26. A retirement calculator as recited in claim 25, wherein:

said primary salary replacement variables represent age values; and said secondary salary replacement variables represent interest rate values.

27. A retirement calculator as recited in claim 26, further comprising:

a jacket having:

an open end;

a social security benefits table printed upon said jacket for estimating the salary replacement value for social security benefits, and a worksheet printed upon said jacket for calculating a total salary replacement value;

said sleeve being slidably insertable into the open end of said jacket.

28. A retirement calculator as recited in claim 25, wherein:

said primary salary replacement variables represent age values; and said secondary salary replacement variables represent retirement age values.

29. A retirement calculator as recited in claim 28, further comprising:

a jacket having:

an open end;

a social security benefits table printed upon said jacket for estimating the salary replacement value for social security benefits, and a worksheet printed upon said jacket for calculating a total salary replacement value;

said sleeve being slidably insertable into the open end of said jacket.

30. A retirement calculator as recited in claim 25, wherein:

said primary salary replacement variables represent age values; and said secondary salary replacement variables represent age of death values.

31. A retirement calculator as recited in claim 30, further comprising:

a jacket having:

an open end;

a social security benefits table printed upon said jacket for estimating the salary replacement value for social security benefits, and a worksheet printed upon said jacket for calculating a total salary replacement value;

said sleeve being slidably insertable into the open end of said jacket.

* * * * *